United States Patent [19]

Ito et al.

[11] Patent Number: 4,545,141

[45] Date of Patent: Oct. 8, 1985

[54] AUTOMATIC DOCUMENT PAGE TURNING APPARATUS

[75] Inventors: Masakazu Ito, Hiratsuka; Hikaru Izawa, Yokohama, both of Japan

[73] Assignee: NCR Corporation, Dayton, Ohio

[21] Appl. No.: 653,813

[22] Filed: Sep. 24, 1984

[30] Foreign Application Priority Data

Sep. 30, 1983 [JP] Japan ..... 58-180963

[51] Int. Cl.[4] ..... G09F 13/00

[52] U.S. Cl. ..... 40/531; 84/487; 40/475

[58] Field of Search ..... 40/531, 475, 530, 476, 40/380; 84/487

[56] References Cited

U.S. PATENT DOCUMENTS

| | | | |
|---|---|---|---|
| 3,053,000 | 9/1962 | Schmidt | 40/531 |
| 3,064,518 | 11/1962 | Chernishenko | 40/531 |
| 3,087,268 | 4/1963 | Rice | 40/531 |
| 3,165,846 | 1/1965 | Piller | 40/475 |
| 3,217,435 | 11/1965 | Steirt | 40/475 |
| 3,570,154 | 3/1971 | Cosenza | 40/475 |
| 4,275,179 | 3/1981 | Oka et al. | 40/475 |

*Primary Examiner*—Gene Mancene
*Assistant Examiner*—Wenceslao J. Contreras
*Attorney, Agent, or Firm*—Wilbert Hawk, Jr.; Edward Dugas; Richard W. Lavin

[57] ABSTRACT

An automatic page turning apparatus associated with a closed passbook and the like includes feed means for positioning and holding one edge of a passbook at a station located along a guide chute, and a drive member movable in a direction perpendicular to the guide chute for engaging and moving the passbook to a bowed configuration where a rotating drive roller engages the cover member or the top page member of the bowed passbook for moving the member to a partially open position. Control means operates the feed means to move the passbook in a direction enabling the drive roller to move the partially open member to a fully open position. Circuit means varies the power applied to the drive member enabling the drive member to apply more pressure to the passbook where the cover member is to be turned.

14 Claims, 10 Drawing Figures

AUTOMATIC DOCUMENT PAGE TURNING APPARATUS

CROSS-REFERENCE TO RELATED APPLICATIONS

Automatic Issuance of Passbooks and the Like, copending application Ser. No. 653,814 and still pending, filed on even date herewith, invented by Masaru Nogami, Masafumi Inaba and Yoshitaka Oki, assigned to the NCR Corporation.

BACKGROUND OF THE INVENTION

The present invention relates to document printing apparatus and more particularly to an apparatus for automatically opening a passbook cover and subsequent pages of the passbook for printing data thereon.

In recent years, there has been a trend to automate banking functions as they relate to bank customers. An example of this trend is the Automatic Teller Machines (ATM's) which provide remote banking functions without the presence of a bank teller. One of these functions is the automatic issuance of passbooks and other types of multiple-sheet documents. In issuing a passbook, data pertaining to the name of the owner, his account number, etc. is required to be printed on the cover of the passbook and on subsequent pages of the passbook. Mechanisms have been developed for automatically turning the pages of the passbook before printing on the pages occurs. An example of a prior art page turning mechanism may be found in U.S. Pat. No. 4,280,036, in which friction rollers are pressed against the passbook when in an open position while clamp means rigidly holds the passbook spaced from the roller, and retaining pins penetrating between the uppermost leaf of the open passbook, which is partially lifted by the rotation of the friction rollers. It has been found in this construction that, due to the thickness and stiffness the cover of the passbook, the cover cannot be turned and the passbook has to be inserted into the printing apparatus by the clerk in an open condition. This limitation prevents such a mechanism from being used in ATM's. It is therefore a principal object of this invention to provide a page-turning mechanism which is capable of turning page members of a passbook of varying thicknesses. It is another object of the present invention to provide such a mechanism for turning over the cover of a passbook when the passbook is in a closed position.

SUMMARY OF THE INVENTION

In order to carry out these objects, there is disclosed a mechanism for turning over the cover and the inner pages of a passbook or other type of multiple-page document which includes a guide chute along which a closed passbook is transmitted to a page turning station, a page turning roller positioned adjacent the guide chute at the page turning station which is adapted to be rotated in a page-turning direction, a drive member mounted adjacent the guide chute opposite the page turning roller which is movable in a direction to engage and move the passbook into a bowed position in which the top page or cover of the passbook is engaged by the page turning roller whose operation turns the cover or the page of the passbook to a partially open position and then to a fully open position upon movement of the passbook along the guide chute and control means for controlling the amount of force exerted by the drive member on the passbook whereby the force applied to the drive member varies depending on whether the cover or another page of the passbook is to be turned.

BRIEF DESCRIPTION OF THE DRAWINGS

The foregoing and other objects, advantages and features of the invention will be described in greater detail, taken in connection with the drawings wherein.

DESCRIPTION OF THE PREFERRED EMBODIMENT

Figure 1:
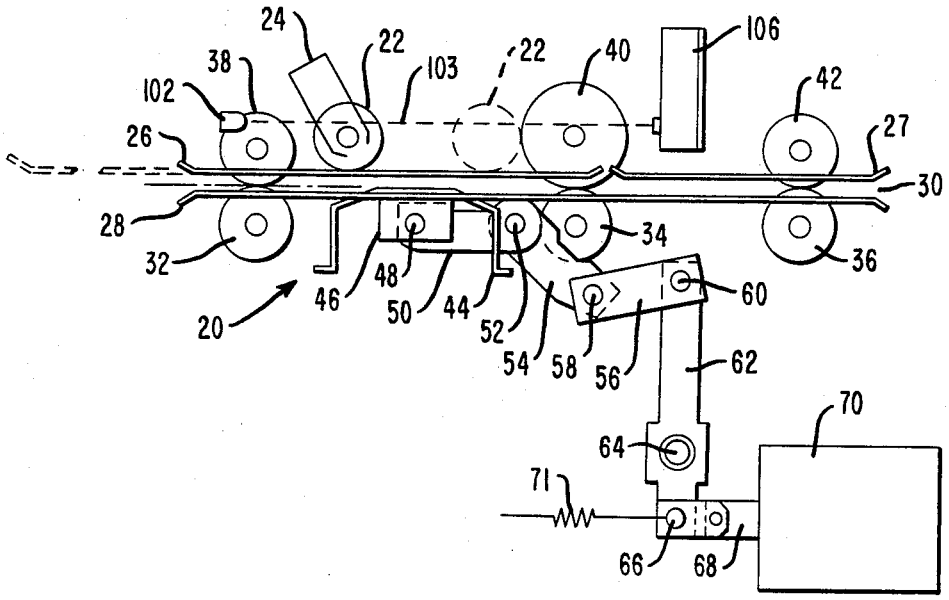
FIG. 1 is a side view of the page turning apparatus of the present invention showing the linkage arrangement for moving the drive member into engagement with the passbook.
Figure 7:
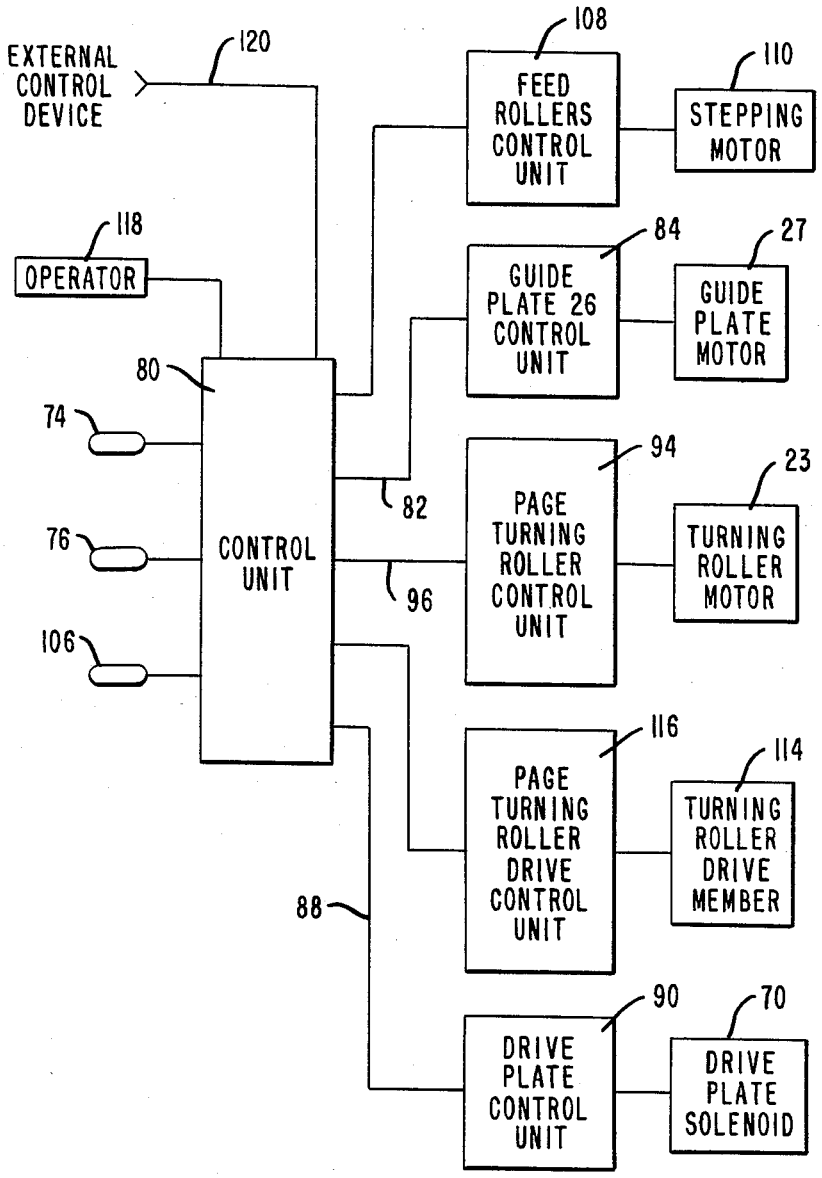
FIG. 7 is a block diagram of the control system of the page turning apparatus.

Referring now to FIG. 1, there is disclosed a side view of the page turning apparatus of the present invention which is indicated generally by the numeral 20 and which includes a page turning roller 22 rotatably mounted on a support member 24 in which the roller 22 is operated by a conventional drive means such as a motor 23 (FIG. 7). The roller 22 is mounted adjacent a plurality of guide plate members 26, 27 and 28 which form a guide chute 30. The guide plate member 26 is slidably mounted for longitudinal movement to the dotted position shown in FIG. 1 by a drive mechanism (not shown) operated by a drive member 27 (FIG. 7). Mounted adjacent the guide chute 30 are a plurality of rubber drive rollers 32–36 inclusive operated by a conventional motor-driven belt (not shown) in which each of the drive rollers coacts with an associated pressure roller 38–42 inclusive in a manner that is well-known in the art to move a closed passbook along the guide chute 30. Reference should be made to the previously cited Nogami et al. reference for a description of the feed mechanism for feeding a closed passbook into the guide chute 30.

Located adjacent the guide plate member 28 opposite the page turning roller 22 is a U-shaped drive plate member 44 having a depending support portion 46 to which is rotatably mounted by means of a stud 48 one end of an arm member 50. The other end of the arm member 50 is fixed to a rotatably mounted shaft member 52 to which is also fixed one end of a second arm member 54. The other end of the arm member 54 is rotatably connected to one end of a link member 56 by means of the stud 58. In a similar manner, the link member 56 is rotatably connected by means of a stud 60 to one end of a lever member 62 which in turn is rotatably mounted on a fixed shaft member 64. The other end of the lever member 62 is rotatably secured by means of a stud 66 to one end of an armature member 68 associated with a solenoid 70. Also engaging the stud 66 on one end of a spring member 71 for normally returning the lever member 62 to its home position. As will be described more fully hereinafter, energizing of the solenoid 70 results in the upward movement of the drive plate member 44.

Figure 2:
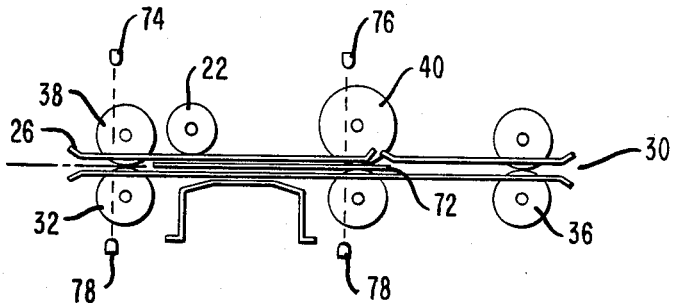
FIG. 2 is a partial side view of the page turning apparatus of FIG. 1 showing the location of the passbook prior to a page turning operation.

Referring now to FIGS. 2–7 inclusive, there is shown side views of the page turning mechanism during a page turning operation together with the control unit for operating the page turning mechanism. As shown in FIG. 2, a closed passbook member 72 with its bound edge portion orientated in the forward direction is driven by the feed rollers 32 and 34 in a left-to-right direction as viewed in FIG. 2. The passbook member 72 is sensed by a pair of photodetectors 74, 76 which cooperate with a light source 78 in a manner that is well-known in the art to sense the leading and trailing edges of the passbook member 72. Signals generated by the photodetectors 74, 76 are transmitted to a control unit 80 (FIG. 7) which detect whether the passbook member 72 is in an open or closed condition by measuring the time interval between the operation of the photodetectors 76 and 74. The control unit 80 comprises a microprocessor and firmware which control various portions of the page turning mechanism in a predetermined order in response to receiving control signals transmitted from the photodetectors 74, 76 together with signals generated from an operator's keyboard 118 (FIG. 7) or transmitted over line 120 from an external device such as an ATM. As will be described more fully hereinafter, detecting the closed or open position of the passbook will control the amount of pressure that the drive plate member 44 will exert on the passbook 72 upon movement of the drive plate member into engagement with the passbook member.

Figure 3:
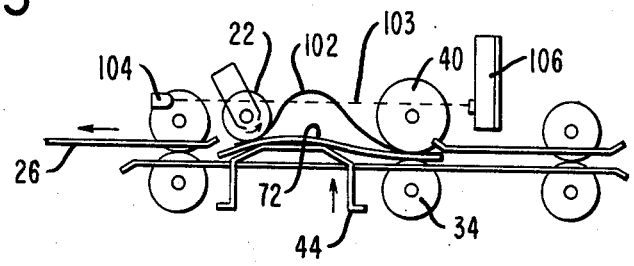
FIG. 3 is a partial side view of the page turning apparatus of FIG. 1 showing the drive member in an actuated position and the passbook in a bowed configuration.

In response to the signals generated by the photodetectors 74, 76 a reversible drive motor 27 (FIG. 7) operatively connected to the guide plate member 26 (FIG. 1) by any conventional means such as a rack and pinion mechanism will slide the guide plate member 26 to the left as shown in FIG. 3 removing the guide plate member from a blocking position with respect to the drive plate member 44. After the guide plate member 26 has been moved to an actuated position (FIG. 3), the control unit 80 will output control signals over line 88 to a drive plate control unit 90 which outputs energizing signals to the solenoid 70 (FIGS. 1 and 7). The operation of the solenoid 70 results in the movement of the armature member 68 to the right as viewed in FIG. 1 actuating the linkage arrangement connecting the drive plate member 44 resulting in the movement of the drive plate member 44 in an upward direction engaging the passbook member 72. The passbook member 72 at this point has its bound end engaged and held by the drive roller 34 and the pressure roller 40. Movement of the drive plate member 44 moves the passbook member 72 into a curved or bowed configuration (FIG. 3) allowing the cover or top page member 102 to engage the page turning roller 22. At this time, the roller 22 is being rotated in a counterclockwise direction by the motor 23 (FIG. 7) under the control of a control unit 94 which in turn is operated in response to control signals transmitted over line 96 from the control unit 80.

Figure 4:
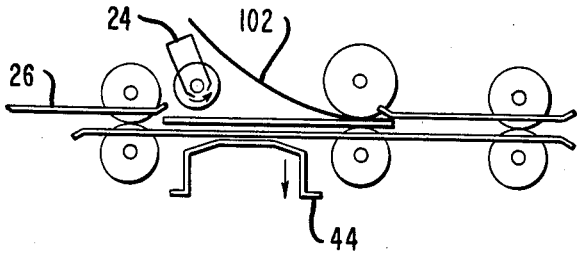
FIG. 4 is the same view as FIG. 3 showing the position of the page turning roller after the cover or page member has been rotated to an engaging position with the page turning roller support member.
Figure 5:
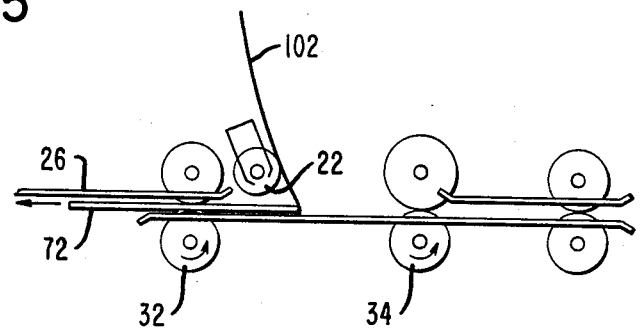
FIG. 5 is the same view as FIG. 4 showing the passbook after its initial movement resulting in the page turning roller turning over the cover or page member of the passbook to a partial open position.

Rotation of the page turning roller 22 results in the cover or top page member 102 being rotated to a position which intercepts a light beam 103 outputted from a light source 104 (FIGS. 1 and 3) and which is normally detected by a photodetector 106. The interception of the light beam 103 by the cover member or top page member 102 results in the photodetector member 106 outputting a signal to the control unit 80. The control unit 80 in response to receiving the signal from the member 101 will output a control signal to the drive plate control unit 90 which deenergizes the solenoid 70 allowing the spring member 71 (FIG. 1) to return the armature member 68 to its home position moving the drive plate member 44 in a downward direction (FIG. 4). The roller member 22 continues rotating in a counterclockwise direction for a predetermined time period rotating the cover or top page member 102 to a partially-open position adjacent the roller support member 24 (FIG. 4). After the predetermined time period has elapsed, the control unit 80 will output appropriate control signals to the page turning roller control unit 94 (FIG. 7) which disables the motor 23 stopping the rotation of the page turning roller member 22.

Figure 6:
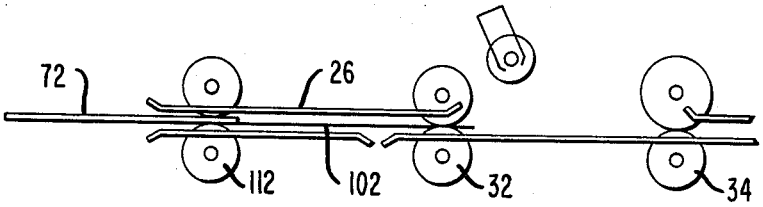
FIG. 6 is the same view as FIG. 5 showing the position of the passbook after the cover or page member has been turned to an open position.

The control unit 80 will also output control signals to the feed roller control unit 108 (FIG. 7) which operates a stepping motor 110 which in turn operates a belt drive system (not shown) for rotating the feed rollers 32, 34 (FIG. 5) in a counterclockwise direction. This rotation of the feed rollers results in the leftward movement of the passbook member 72 as viewed in FIG. 5 resulting in the stationary page turning roller 22 rotating the partially opened cover member 72 to a completely open position (FIG. 6). The rotation of the cover or top page member 102 to an open position enables the photodetector 106 (FIG. 3) to generate a signal which is transmitted to the control unit 80. In response to receiving this signal, the control unit 80 will output the appropriate control signals to the guide plate control unit 84 (FIG. 7) which operates the motor 86 to move the guide plate member 26 to its home position (FIG. 1). At this time, the feed rollers 112, 32–36 inclusive (FIG. 6) are operated to drive the open passbook member 72 through the guide chute 30 to a position adjacent a printing mechanism (not shown) where printing on the open cover member 102 occurs. For a complete description of the processing of the passbook member 72, reference should be made to the previously cited U.S. patent application Ser. No. 653,814 and still pending of Nogami et al.

Where an inner page member of the passbook member 72 is required to be turned, the passbook member is again positioned adjacent the drive plate member 44 (FIG. 2) and the sequence of operation of the drive plate member 44 and the page turning roller 22 is repeated. In this instance, the pressure exerted by the drive plate member 44 on the passbook member 72 is reduced in a manner to be described more fully hereinafter. Where alternate printing operations are to occur on either side of the same page or alternate pages of the passbook member, the passbook member is positioned adjacent the drive plate member 44 with the bound edge portion of the passbook member held between the feed roller 32 and the pressure roller 38 (FIG. 2). A drive member 114 (FIG. 7) engaging the page turning roller 22 is energized by signals transmitted from the page turning roller drive control unit 116 (FIG. 7) as a result of the control unit 80 receiving control signals from either the operator control unit 118 or over line 120 from an external control device. Energizing of the drive member 114 results in the movement of the page turning roller member 22 to the dotted position shown in FIG. 1 adjacent the pressure roller 40. The control unit 80 will output control signals to the page turning roller control unit 94 resulting in the energizing of the roller drive motor 23 for rotating the page turning roller member 22 in a clockwise direction enabling the page of the passbook engaged by the roller 22 to be turned in a clockwise direction to an open position upon the subsequent movement of the passbook to the right as viewed in FIG. 1.

Figure 8:
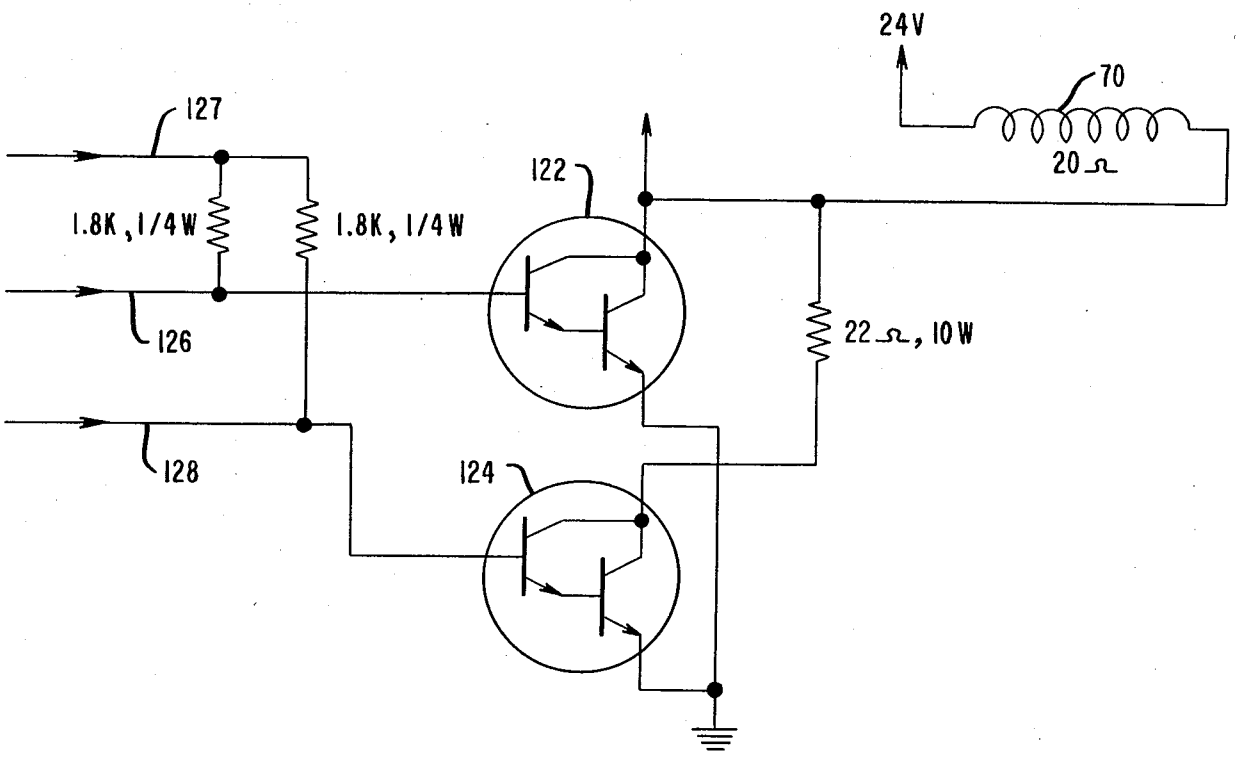
FIG. 8 is a schematic diagram of the control circuit for varying the force exerted on the passbook by the drive member.

Referring now to FIG. 8, there is shown a schematic diagram of a control circuit found in the drive plate control unit 90 (FIG. 7) for varying the pressure applied by the drive plate member 44 on the passbook member 72. Included in the circuit are cascaded pairs of NPN transistors 122 and 124. When the cover or top page member 102 of the passbook member 72 is to be turned to an open position, the control unit 80 (FIG. 7) transmits an energizing signal over line 126 in addition to an enabling signal over line 127 turning on the pair of transistors 122 which enables current to flow from a 24 volt power supply through the solenoid 70 at a level producing a force which is applied to the passbook member 72 by the drive plate member 44 corresponding to a power level as follows.

$$W=24V/20\ X24V=28.8W$$

Where an inner page member of the passbook member 72 is to be turned, an energizing signal is transmitted over line 128 which turns on the cascaded pair of transistors 124. The current flowing through the solenoid 70 produces a pressure force on the passbook member 72 in accordance with the following power level.

$$W=24V/(20+22)X24V=13.7W.$$

It is obvious that these values are exemplary and other values can be selected in accordance with the thickness and stiffness of the cover and the inner pages of the passbook member or other documents being processed.

Figure 9A:
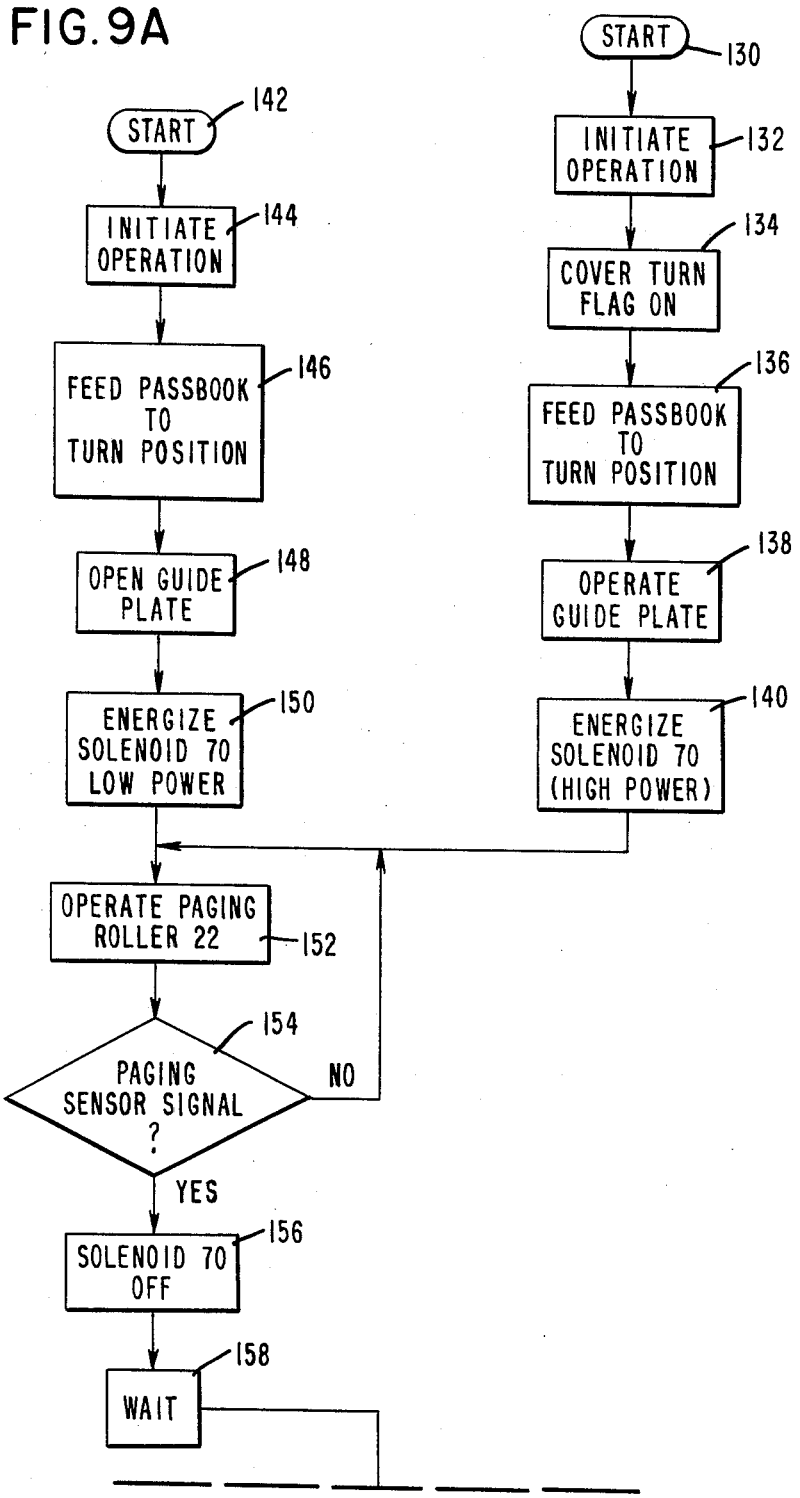
FIGS. 9A and 9B taken together disclose a detailed flowchart of the page turning operation.
Figure 9B:
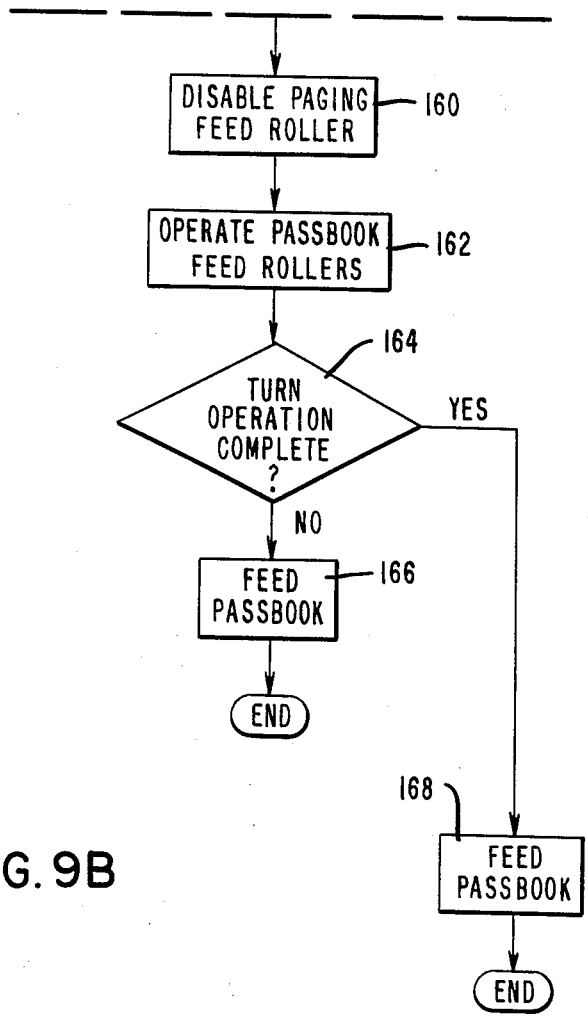

Referring now to FIGS. 9A and 9B inclusive, there is disclosed a flowchart of the page turning operation. When the passbook member 72 is initially sent to the page turning mechanism at the start (block 130) of the operation, a signal initiating the operation of the page turning mechanism (block 132) is transmitted either from the operator control unit 118 (FIG. 7) or over line 120 from an external control device such as a keyboard on an ATM. The generation of the signal results in the microprocessor in the control unit 80 generating a cover turn flag (block 134) enabling the feed roller control unit 108 (FIG. 7) operating the stepping motor 110 to feed (block 136) the passbook member 72 to a page turning position (FIG. 2). The guide plate member 26 is then removed (block 138) from a blocking position adjacent the drive plate member 44. The member 44 is then moved to a position engaging the passbook member (FIG. 3) upon the energizing of the solenoid 70 (block 140) in a high power mode. If the passbook member 72 is in an open position, the steps of starting (block 142), initiating (block 144) an operation, feeding (block 146) the passbook member to a page turning position, opening (block 148) the guide plate member and energizing (block 150) the solenoid 70 is repeated except that the energizing of the solenoid occurs in the low power mode.

After the passbook member 72 has been moved into engagement with the page turning roller 22 (FIG. 3), the roller is operated (block 152) to bow the cover or page member 102 of the passbook member and the photodetector 106 is checked to see if a signal has been generated (block 154) indicating the interception of the light beam 103 by the curved cover or page member (FIG. 3). If the signal is not present, the roller 22 continues operation (block 152). If the signal is present, the solenoid 70 is deenergized (block 156). The system will wait (block 158) for a predetermined time period until the cover or inner page member 102 is positioned on the roller support member 24 (FIG. 4). After the predetermined time period has elapsed, the roller 22 is disabled (block 160) (FIG. 9B) and the feed rollers 32, 34 (FIG. 5) are operated (block 162) to move the passbook member in a direction enabling the stationary roller 22 to rotate the cover or inner page member to a fully opened position. The system will check the output of the photodetector 106 to see if the turning of the cover or inner page member 102 has been completed (block 164). If the turning operation has not been completed, the passbook member 72 is moved further to a position (block 166) where the turning of the cover or inner page member is completed. If the turning operation has been completed, the passbook member is transmitted (block 168) either to a printing station or to a completed turning position where the passbook is held in an open position which completes the page turning operation.

It will be seen from this construction that a passbook member in a closed position can be processed automatically to allow printing to occur on the cover member and the inner page members. This allows the page turning mechanism to be employed in ATM's or other remote facilities which do not require the presence of a bank clerk or other type of operator.

While the invention has been described in its preferred embodiment, it is to be understood that the words which have been used are words of description rather than limitation, and that changes in construction may be made within the purview of the appended claims without departing from the true scope and spirit of the invention in its broader aspects.

We claim:

1. A document page turning apparatus comprising;

a support member for supporting a multiple-page document along a feed path;

first means positioned adjacent the support member for feeding the document along the feed path to a turning station;

means positioned adjacent the support member and mounted for movement in a direction for engaging and moving a document positioned at the turning station to a bowed configuration when actuated;

means for actuating said engaging and moving means;

second feeding means positioned adjacent the support member engaging the top page of the bowed document and operable for rotating such top page to a partially open position adjacent the second feeding means;

and means for operating the first feeding means to feed the documents in a direction along said support member enabling the second feeding means to engage and rotate the partially open top page to a fully open position.

2. The apparatus of claim 1 in which said first feeding means includes a pair of rollers engaging and holding one edge of the document therebetween when positioned in the turning station and said engaging and moving means comprises a drive member mounted for movement in a direction perpendicular to the movement of the document on the support member for engaging and rotating the document to a bowed configuration when actuated.

3. The apparatus of claim 2 in which said drive member comprises an arcuate shaped plate member and said first operating means includes an actuating member and connecting means interconnecting said plate member and said actuating member whereby upon operation of said operating member, said connecting means will move said plate member in a direction perpendicular to the movement of the document on the support member engaging and rotating the document to a bowed configuration.

4. The apparatus of claim 3 in which said document comprises a closed passbook member having a cover number and at least one page number, said apparatus further includes circuit means connected to said actuating member for varying the pressure applied by said actuating member to said connecting means whereby the amount of force applied by the plate number on the passbook member varies accordingly to whether a cover member or a page member is engaged by said second feeding means.

5. The apparatus of claim 3 in which said connecting means includes rotatably mounted connecting link members interconnecting said plate member and said actuating member whereby upon operation of said actuating member, said link members are rotated to move said plate member in a perpendicular direction.

6. The apparatus of claim 4 which further includes sensing means positioned adjacent said turning station for generating a control signal upon sensing the document in a bowed configuration, and control means connected to said sensing means and said actuating member for disabling the operation of said actuating member in response to the generation of said control signal whereby the plate member is removed from engagement with the document.

7. A document page turning apparatus comprising;

a plurality of plate members forming a guide chute for supporting a multiple-page document along a feed path;

a plurality of first feed rollers positioned adjacent the guide chute for feeding the documents along the feed path to a turning station;

a drive member positioned adjacent a guide chute and mounted for movement in a direction to engage and move a document positioned at the turning station to a bowed configuration when actuated;

means for actuating said drive member when operated;

a second feed roller positioned adjacent said guide chute opposite said drive member for engaging the top page member of the document upon movement of the document to a bowed configuration;

means for rotating said second feed roller when operated whereby the second feed roller will rotate the top page member to a partially open position;

and control means for operating said first feed rollers to move a document along the feed path toward the second feed roller whereby said second feed roller will move the top page number to an open position.

8. The apparatus of claim 7 in which two of said first feed rollers engage and hold one edge of the document when the document is at the turning station, and said drive member comprises an arcuate shaped plate member adapted to rotate the document about the engaged edge to a bowed configuration.

9. The apparatus of claim 8 in which said document comprises a passbook having a cover member and at least one inner page member, said actuating means includes circuit means for varying the force applied by the actuating means to the drive member whereby the force applied by the drive member against the passbook is greater when the cover member is to be turned than when an inner page member is to be turned.

10. The apparatus of claim 9 in which said actuating means further includes an actuator member operated by said circuit means and connecting means interconnecting said actuator member and said plate member whereby upon operation of said actuator member, said connecting means will move said plate member in a direction perpendicular to the movement of the passbook engaging and rotating the passbook to a bowed configuration.

11. The apparatus of claim 10 in which said connecting means include a plurality of rotatably mounted interconnecting link members engaging said plate member and said actuating member whereby upon operation of said actuating member, said link members are rotated to move said drive plate member in a direction perpendicular to the movement of the passbook.

12. The apparatus of claim 11 in which said actuating member comprises an electromagnetic drive member.

13. The apparatus of claim 12 which further includes first sensing means positioned adjacent the turning station for generating first control signals upon the positioning of the passbook at the turning station and control means connected to said sensing means and said actuating member for operating said actuating member in response to the generation of said first control signals whereby said drive plate member is moved in a direction perpendicular to the movement of the passbook.

14. The apparatus of claim 13 which further includes second sensing means positioned adjacent the turning station for generating second control signals upon movement of the passbook to a bowed configuration, said control means connected to said second sensing means and said actuating member for disabling the operation of said actuating member in response to the generation of said second control signal.

* * * * *